United States Patent [19]

Schwartz

[11] Patent Number: 4,993,707

[45] Date of Patent: Feb. 19, 1991

[54] BASKETBALL ACCESSORY

[76] Inventor: Shadrach A. Schwartz, 9501 Cove Ave., Pensacola, Fla. 32514

[21] Appl. No.: 501,782

[22] Filed: Mar. 28, 1990

[51] Int. Cl.[5] ..... A63B 69/00

[52] U.S. Cl. ..... 273/1.5A

[58] Field of Search ..... 273/1.5 A, 58 C, 65 EG

[56] References Cited

U.S. PATENT DOCUMENTS

| | | | |
|---|---|---|---|
| 2,011,760 | 8/1935 | Gallinant | 273/65 EG |
| 3,709,491 | 1/1973 | Minchin | 273/58 C |
| 4,071,239 | 1/1978 | Ferguson | 273/58 C X |
| 4,147,353 | 4/1979 | Moore | 273/58 C X |
| 4,592,549 | 6/1986 | Ryan | 273/58 C |

*Primary Examiner*—Paul E. Shapiro

*Attorney, Agent, or Firm*—John K. Donaghy

[57] ABSTRACT

A basketball accessory comprising a first strap of predetermined width having its ends overlapped and secured together; a second strap equal dimensioned to the first strap; said first and second straps attached to each other at their crossing point such that the overlapped sections are diagrametically opposite each other; said straps forming a harness to tightly fit the circumference of a basketball.

11 Claims, 1 Drawing Sheet

BASKETBALL ACCESSORY

BACKGROUND OF THE INVENTION:

1. Field of the Invention:

This invention pertains to a basketball accessory for aiding in slamming the basketball into the net.

2. Background of the Prior Art:

No prior art is known to the inventor.

SUMMARY OF THE INVENTION:

There is a need for an accessory to allow a player to increase his reaching and jumping capabilities in pursuit of slamming the basketball into the net.

Many individuals with average height and ability can jump high enough to extend a hand past the top of the rim on a basketball hoop. The average person, however, cannot palm a basketball to the extent of providing complete control of the ball up and over the rim, thus creating what is called slamming. The "SLAMIN STRAP", as this invention is called, is what provides the control for a person to hold onto the ball while extending the hand past the rim allowing one to slam. It is important to point out that a person's reaching and jumping abilities are hampered when they cannot palm or control the ball to the net. A person's energy and focus is thus divided in two. Part one is the individual's concentration on performing a balancing act with the basketball in his hand due to the person's inability to palm or control the ball. This deterrent to concentration and energy takes away the total focus of one's ability to concentrate on reaching and jumping only. It is important to note that when balancing or cupping the ball on the palm of the hand, the height and trajectory of the ball is inhibited making the slam difficult and in most cases impossible. However, using the "SLAMIN STRAP" allows one the ability to control the ball during the jump and reach during one's ascent to the basketball rim and in addition allows one to control the ball from an extended position of the hand and forearm thus creating additional inches necessary for slamming.

The "SLAMIN STRAP" functions not only as an aid to the individual who cannot slam due to lack of size and palming ability, but also is a training device for the professional who already maintains the height, hand size and ability to slam a basketball. In fact, slamming is so popular in the N.B.A., and other associations, that slamming contests are held which offer substantial prize money awards.

Further, training equipment is used in many sports to aid participants during training. For example, in gymnastics one who performs on a trampoline is aided in practice sessions by a harness or strap which is fitted around the waist and guided by ropes for stability. Even though the gymnast is already capable of performing flips, twists and turns, this harness allows the gymnast to refine his showmanship and style under a more controlled atmosphere. Likewise, the "SLAMIN STRAP" provides the professional basketball player with a more controlled atmosphere to create new moves and styles and to refine the showmanship of their slamming ability.

It is, therefore, one object of this invention to provide an accessory for a basketball in the nature of a harness which is removably fitted about the circumference of a basketball.

It is another object of this invention to provide a harness or strap set which friction fits to the circumference of a basketball.

Yet another object of this invention is to provide a harness fitted to the basketball in such a way as to permit a person to insert a hand between the ball and the strap thus allowing the person to artificially palm a basketball which otherwise would not be possible.

The most unique function of this palming ability of the ball allows an average size player to increase his reaching and jumping capabilities in the pursuit of slamming the ball into the basket as do taller players.

Another important object of this invention is to provide a player with the ability to control ball rotation during shooting. The traditional basketball is separated into eight lines ranging from $\frac{1}{4}''$ to $\frac{3}{8}''$ maximum. Because of the narrowness of these lines and the camouflaged color of the ball, the ability of the player to see the rotation of the ball is greatly diminished. The use of the harness of this invention enhances the player's visual observation of the ball's rotation as it travels toward the net.

DESCRIPTION OF THE PREFERRED EMBODIMENT OF THE INVENTION

Figure 1:
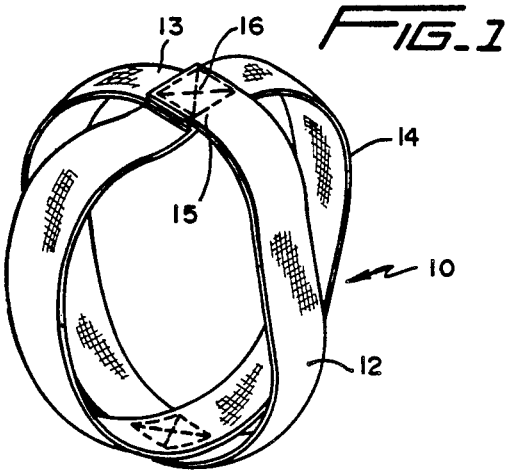
FIG. 1 is a perspective view of the harness of this invention.
Figure 2:
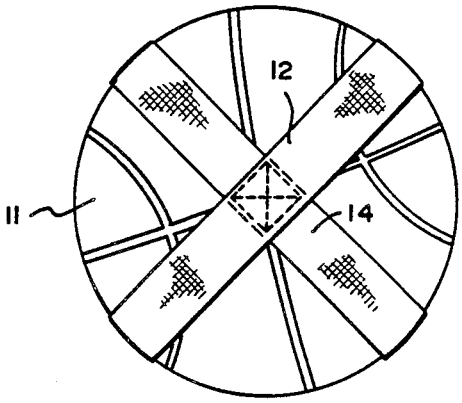
FIG. 2 is a perspective view of a basketball with the harness snugly fitted about the circumference thereof.

Referring now in more detail to the drawings. FIGS. 1 and 2 show a harness 10 comprising a first strap 12 with a width up to 2". Strip 12 is made of an elastic material and is of a diameter which allows it to tightly fit about the circumference of the ball 11. The ends 13 and 15 of strap 12 are overlapped and fastened together by any suitable means. A second strap 14, identical to the first, is attached by any suitable means to the overlapped portion of the first strap at the point 16 where strap 14 crosses over strap 12 The identical arrangement is at the opposite juncture. By securing the straps in this manner, the harness, as a single unit, fits the ball without moving about the periphery or slipping off.

Figure 3:
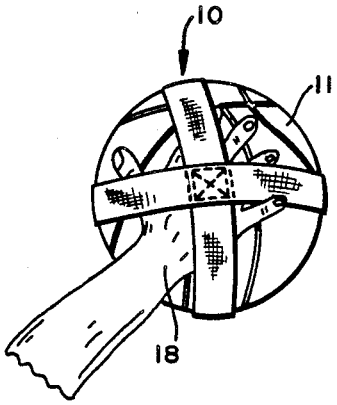
FIG. 3 is a view of the ball and harness with a player's hand held against the ball by the harness.
Figure 4:
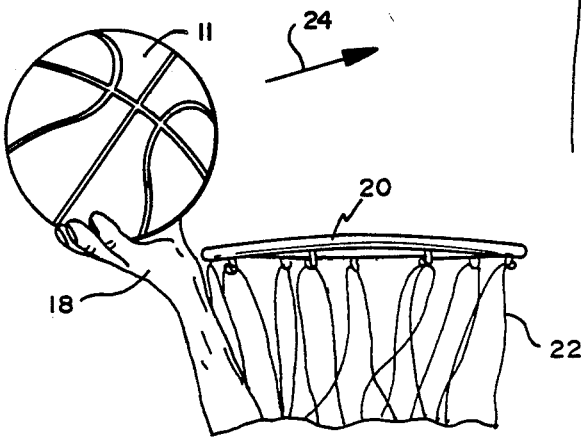
FIG. 4 is a view of a hand cupping the ball with ball trajectory shown by the arrow.
Figure 5:
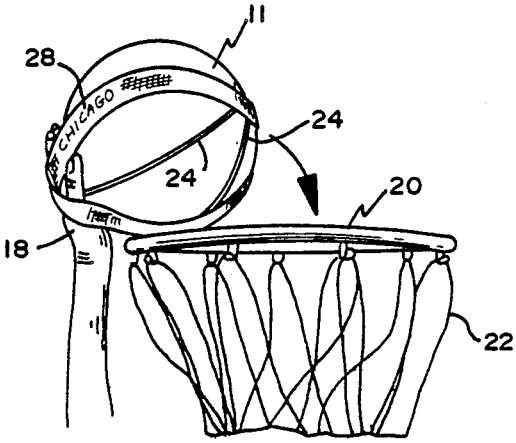
FIG. 5 is a view of the ball elevated over the rim of the net which shows one strap of the harness with indicia thereon.

FIG. 3 shows the harness 10 fitted to the ball 11 tightly enough whereby a player's hand 18 is held firmly against the ball. This firm fit allows a player to artificially palm the ball 11 which otherwise would not be possible. FIG. 4 shows palming of the ball by an average size player. It is evident that, while the player's hand 18 and ball 11 have reached the rim 20, slamming the ball into the net 22 is not possible as the trajectory of the ball is upward in the direction of arrow 24. It is precisely this state of artificial palming of the ball which allows a player to reach over the rim 20, FIG. 5, and slam the ball into the net 22. The force of the slam propels the ball off the player's hand 18 and down into the net 22.

Due to the narrow lines 24, 26 on the ball 11, it will be evident that the player's ability to see the rotation of the ball diminished rapidly, the further the ball travels away from the player. This happens because the lines on traditional basketballs are very thin and are lost by the camouflaged color. However, with the harness 10 and a strap width of 2", the player can clearly see the rotation of the ball even as it reaches the net 22. Thus, the harness 10 on the ball 11 allows the player to gauge or adapt his rotation of the ball while shooting the ball at an optimum speed toward the net.

The harness 10 of this invention allows a player to carry the ball with one finger hooking the harness at any point. The team name, player's name or advertising may be printed on the strap as indicated by the indicia 28.

While the invention has been described with respect to a preferred embodiment thereof, it will be appreciated by those skilled in the art to which the invention pertains that numerous changes may be made in the invention to enhance its function without departing from the spirit and scope thereof.

WHAT I CLAIM IS:

1. A basketball accessory comprising:

a first strap of predetermined width having its ends overlapped and secured together;

a second strap equal dimensioned to the first strap;

said first and second straps attached to each other at their crossing point such that the overlapped sections are diagrametically opposite each other; and said straps forming a harness to tightly fit the circumference of a basketball.

2. A basketball accessory according to claim 1, wherein:

said harness permits a player to palm the ball thus allowing the player to increase his reaching and jumping capabilities in pursuit of slamming the ball into the net.

3. A basketball accessory according to claim 1, wherein:

said harness provides a visible means whereby a player views the rotation of the ball as it travels toward the net.

4. A basketball accessory according to claim 1, wherein:

said harness provides for greater control of the speed of the ball as it travels toward the net.

5. A basketball accessory according to claim 1, wherein:

said straps are made of elastic material.

6. A basketball accessory according to claim 1, wherein:

said straps are each 2" wide.

7. A basketball accessory according to claim 1. wherein:

said straps permit application of various indicia there on.

8. A basketball accessory according to claim 7, wherein:

said indicia may be a team name.

9. A basketball accessory according to claim 7, wherein:

said indicia may be a player's name.

10. A basketball accessory according to claim 7, wherein:

said indicia may be promotional material.

11. A basketball accessory according to claim 1, and said harness provides a handle for carrying the basketball.

* * * * *